US008562764B2

(12) United States Patent
Watanabe et al.

(10) Patent No.: US 8,562,764 B2
(45) Date of Patent: Oct. 22, 2013

(54) COPPER ALLOY TUBE FOR HEAT EXCHANGERS

(75) Inventors: Masato Watanabe, Shinjuku-ku (JP); Takashi Shirai, Shinjuku-ku (JP)

(73) Assignee: Kobelco & Materials Copper Tube, Ltd., Tokyo (JP)

( * ) Notice: Subject to any disclaimer, the term of this patent is extended or adjusted under 35 U.S.C. 154(b) by 1022 days.

(21) Appl. No.: 12/244,195

(22) Filed: Oct. 2, 2008

(65) Prior Publication Data

US 2009/0116997 A1 May 7, 2009

(30) Foreign Application Priority Data

Nov. 5, 2007 (JP) ..... 2007-287935

(51) Int. Cl.
*C22C 9/02* (2006.01)

(52) U.S. Cl.
USPC ..... 148/433; 420/472

(58) Field of Classification Search
USPC ..... 148/433; 420/472
See application file for complete search history.

(56) References Cited

U.S. PATENT DOCUMENTS 6,132,528 A * 10/2000 Brauer et al. ..... 148/434
2009/0101323 A1 4/2009 Takagi et al.

FOREIGN PATENT DOCUMENTS

EP 2 056 056 A1 5/2009
JP 60194033 * 10/1985
JP 04354843 * 12/1992
JP 10219372 * 8/1998
JP 2000-199023 7/2000
JP 2003-268467 9/2003
JP 2003268467 * 9/2003
JP 2006070335 * 3/2006

OTHER PUBLICATIONS

European Search Report issued May 23, 2011 in European Patent Application No. EP20080018474 filed Oct. 22, 2008.

* cited by examiner

*Primary Examiner* — Sikyin Ip
(74) *Attorney, Agent, or Firm* — Oblon, Spivak, McClelland, Maier & Neustadt, L.L.P.

(57) ABSTRACT

A copper alloy tube according to the present invention includes Sn 0.1 to 2.0 mass %, P 0.005 to 0.1 mass %, S 0.005 mass % or less, O 0.005 mass % or less, and H 0.0002 mass % or less, and the remainder has a composition consisting of Cu and unavoidable impurities. And, as is annealed, the copper alloy tube has the following characteristics: a tensile strength in the longitudinal direction of the copper alloy tube is 250 $N/mm^2$ or more; an average grain diameter is 30 μm or less when measured in the direction perpendicular to the thickness direction of the tube, in the cross section perpendicular to the tube axis; and assuming that a tensile strength in the longitudinal direction of the copper alloy tube is σL, and a tensile strength in the circumferential direction of the same is σT, σT/σL>0.93 holds. [With such structure, the copper alloy tube can have a sufficiently high pressure-resistant breaking strength (breaking pressure) without deteriorating its bending workability due to an unnecessarily enhanced tensile strength, and further is excellent in its bending workability and heat resistance.]

20 Claims, 1 Drawing Sheet

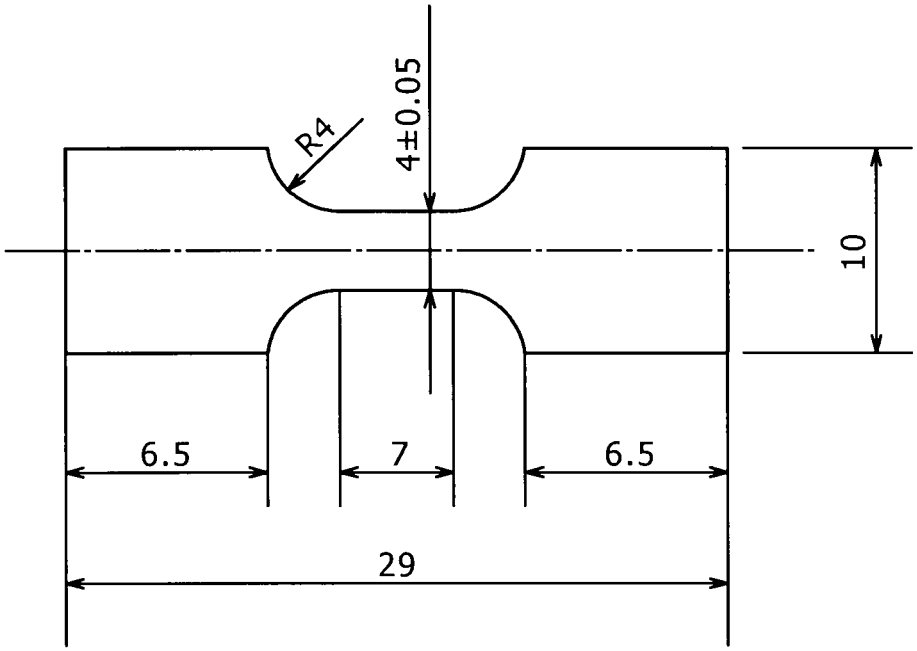
R4
4±0.05
10
6.5
7
6.5
29

COPPER ALLOY TUBE FOR HEAT EXCHANGERS

BACKGROUND OF THE INVENTION

1. Field of the Invention

The present invention relates to a copper alloy tube for a heat exchanger excellent in a pressure-resistant breaking strength and workability.

2. Description of the Related Art

For example, a fin-and-tube-type heat exchanger typically used for an air conditioner, is produced by the following process in which: a U character shaped copper tube bent into a hair-pin like shape (hereinafter, a "copper tube" includes a "copper alloy tube"), is passed through a through hole of a fin made of aluminum or aluminum alloy plate (hereinafter, referred to as an "aluminum fin"); the copper tube is closely in contact with the aluminum fin by extending the copper tube after inserting an extending tool inside the copper tube; a bend copper tube subjected to bending processing in which the copper tube is bent so as to have a U character shape, is inserted into an extended open end of the copper tube after extending the open end of the copper tube; and a plurality of the U character shaped copper tubes are connected to the bend copper tubes, by brazing the bend copper tubes to the extended open ends of the U character shaped copper tubes with a brazing material, such as a phosphor copper brazing alloy.

Therefore, a copper tube used for a heat exchanger is needed to have a good coefficient of thermal conductivity, bending workability, and brazing property. Accordingly, the phosphorus deoxidized copper excellent in these characteristics and having a suitable strength, is widely used.

HCFC (hydrochlorofluorocarbon)-type fluorocarbon had been widely used as a refrigerant used for a heat exchanger, such as an air conditioner; however, HFC (hydrofluorocarbon)-type fluorocarbon has recently become to be used from a viewpoint of protecting the global environment, because the HFC-type fluorocarbon has a lower ozone depletion potential than that of the HCFC-type fluorocarbon. In addition, $CO_2$, a natural refrigerant, has become to be used for a heat exchanger employed in a water heater, air-conditioning equipment for an automobile, or a vending machine or the like. In a heat exchanger, a pressure under which these refrigerants are used (pressure under which a refrigerant flows in a heat transfer tube of the heat exchanger) is maximized in a condenser (a gas cooler in the case of $CO_2$) ; and the pressure is, for example, about 1.8 MPa in the case of R22, HCFC-type fluorocarbon, about 3 MPa in the case of R41, HFC-type fluorocarbon, or about 7 to about 10 MPa (supercritical state) in the case of $CO_2$, showing that an operating pressure of the newly adopted refrigerant is about 1.6 to 6 times greater than that of R22, a conventional refrigerant.

Assuming that an operating pressure under which a refrigerant flows in a heat transfer tube is P ($N/mm^2$), an outer diameter of the heat transfer tube is D (mm), a tensile strength of the heat transfer tube (in the longitudinal direction thereof) is $\sigma$ ($N/mm^2$), and a thickness of the heat transfer tube is t (mm) (a bottom thickness in the case of an inner grooved tube), $P=2\times\sigma\times t/(D-0.8\times t)$ holds. When the above equation is arranged with respect to t of the thickness, $t=(D\times P)/(2\times\sigma+0.8\times P)$ is obtained, indicating that a thickness of a heat transfer tube can be thinner as a tensile strength of the tube is higher. In actually selecting a heat transfer tube, a pressure is at first determined by multiplying the above P by a safety factor: S (typically about 2.5 to 4); and a heat transfer tube, which has a thickness calculated from its tensile strength in the longitudinal direction or has a tensile strength calculated from its thickness using the above determined pressure, is to be selected and used.

Because a heat transfer tube used for the above fin-and-tube heat exchanger is subjected to the U character shape bending processing and the extension processing, an annealed material or a soft material that is an annealed material subjected to slight processing, such as drawing processing, is employed so that the material is flexible enough to be subjected to such processing and can be processed with small power. In the case of a heat transfer tube made of the phosphorus deoxidized copper, its tensile strength is small; therefore a thickness of the tube is needed to be greater to correspond to the increase of the operating pressure of a refrigerant. In addition, because a brazed area is heated to 800° C. or more for several seconds to several tens seconds when assembling a heat exchanger, a grain size is coarsened and a strength of the area is decreased due to being softened in the brazed area and its vicinity compared to other areas; therefore, a thickness of the heat transfer tube is needed to be greater to make up the decrease in its strength due to brazing. Thus, when the phosphorus deoxidized copper is used as a heat transfer tube, a mass of the heat exchanger is increased and a price thereof rises; therefore, there has been a demand for a heat transfer tube that has a high tensile strength, excellent workability, and a good coefficient of thermal conductivity. When the phosphorus deoxidized copper tube is increased in its tensile strength by being subjected to deformation processing, such as the drawing processing, after annealing, the tube with its thinner thickness might be possibly used for a fin-and-tube heat exchanger; however, the tube is unable to be subjected to the bending processing due to its decreased ductility by the deformation processing.

To meet such a demand, a seamless copper alloy tube for a heat exchanger is presented as a copper alloy tube excellent in the 0.2% proof strength and the fatigue strength, the copper alloy tube including, for example: Co 0.02 to 0.2 mass %, P 0.01 to 0.05 mass %, and C 1 to 20 ppm; and the remainder consists of Cu and unavoidable impurities, and an 0 content of the impurities is 50 ppm or less (Japanese Patent Application Laid-Open 2000-199023). Furthermore, another copper alloy tube for a heat exchanger is presented, the copper alloy tube including: Sn 0.1 to 1.0 mass %, P 0.005 to 0.1 mass %, O 0.005 mass % or less, and H 0.0002 mass % or less; and the remainder has a composition consisting of Cu and unavoidable impurities, and the average grain diameter is 30 μm or less (Japanese Patent Application Laid-Open 2003-268467).

While the copper alloy disclosed in Japanese Patent Application Laid-Open 2000-199023 is increased in its tensile strength by precipitation strengthening of Co phosphides, the copper alloy tube is not increased in its pressure-resistant breaking strength commensurately with the increase in tensile strength. Further, the strength of the heat transfer tube is decreased in the vicinity of a brazed area, because the phosphides is made into a solid solution by the brazing heating generated when assembling a heat exchanger. Therefore, there is a problem in that, when used for a heat transfer tube, a thickness of the tube cannot be sufficiently thinner, failing to acquire an intended effect.

In addition, the copper alloy disclosed in Japanese Patent Application Laid-Open 2003-268467, is increased in its strength by the solid solution strengthening of Sn, and is less softened after brazing than the copper alloy of Japanese Patent Application Laid-Open 2000-199023; therefore, when used in a heat transfer, a thickness of the tube can be thinner. However, it has been found that there is a problem in that the copper alloy may break at an unexpected low strength when being subjected to the U character bending processing to form a heat exchanger, because a wrinkle or a crack is easy to occur in a bent portion from where the copper alloy starts to break.

SUMMARY OF THE INVENTION

The present invention has been made in view of these problems and an object of the invention is to provide a copper alloy tube for a heat exchanger, the copper alloy tube being capable of having a sufficiently high pressure-resistant breaking strength (breaking pressure) without deteriorating its bending workability due to an unnecessarily enhanced tensile strength, and further being excellent in its bending workability and heat resistance.

A copper alloy tube for a heat exchanger directed to one aspect of the present invention includes: Sn 0.1 to 2.0 mass %, P 0.005 to 0.1 mass %, S 0.005 mass % or less, O 0.005 mass % or less, and H 0.0002 mass % or less; and the remainder has a composition consisting of Cu and unavoidable impurities, and, as is annealed, the copper alloy tube has the following characteristics: a tensile strength in the longitudinal direction of the copper alloy tube is 250 $N/mm^2$ or more; an average grain diameter is 30 μm or less when measured in the direction perpendicular to the thickness direction of the tube, in the cross section perpendicular to the tube axis; and assuming that a tensile strength in the longitudinal direction of the copper alloy tube is σL, and a tensile strength in the circumferential direction of the same is σT, $\sigma T/\sigma L>0.93$ holds.

The copper alloy tube for a heat exchanger may further include Zn 0.01 to 1.0 mass %.

The copper alloy tube may still further include a total amount of 0.005 to 0.07 mass % of Fe, Ni, Mn, Mg, Cr, Ti, and Ag.

Moreover, the copper alloy tube for a heat exchanger directed to the aspect of the present invention is a tube subjected to the drawing processing, and, as is subjected to the drawing processing, a tensile strength in the longitudinal direction of the tube is 280 $N/mm^2$ or more, and an average grain diameter is 30 μm or less when measured in the direction perpendicular to the thickness direction of the tube, in the cross section perpendicular to the tube axis.

Still moreover, the copper alloy tube for a heat exchanger according to the aspect of the present invention is preferable to have, as is heated at 800° C. for 15 seconds, an average grain diameter of 100 μm or less when measured in the direction perpendicular to the thickness direction of the tube in the cross section perpendicular to the tube axis.

It is noted that the average grain diameter means an average value of 10 measurements taken at any 10 points in the tube axis direction, at each point a grain diameter being measured in the direction perpendicular to the thickness direction of the tube in the cross section perpendicular to the tube axis, in accordance with the cutting method specified in JIS H 0501.

Further, the copper alloy tube for a heat exchanger according to the aspect of the present invention may be an inner grooved tube, for example.

BRIEF DESCRIPTION OF THE DRAWING

Embodiment(s) of the present invention will be described in detail based on the following FIGURE, wherein:

FIG. 1 illustrates a shape of a specimen for micro tensile test.

DETAILED DESCRIPTION OF THE INVENTION

The present invention will be described in detail below. As a result of various experimental study by the present inventor et al., it has been found that a copper alloy tube for a heat exchanger, with which the problems described above are solved, can be obtained by appropriately specifying an Sn content, a P content, an S content, and an average grain diameter in the direction perpendicular to the thickness of the tube, in the cross section perpendicular to the tube axis.

It is generally said that, among P of a breaking pressure of a tube, D of an outer diameter thereof, t of a thickness thereof, and σ of a tensile strength thereof (in the longitudinal direction), $P=2\times\sigma\times t/(D-0.8\times t)$ holds; however, it has been found by the present inventor et al. that there exists a tube that breaks at a pressure higher or lower than the breaking pressure determined by the above equation, depending on the its material (composition) of the tube. Keeping on pressurizing a fluid encapsulated in a tube causes a tensile stress in the circumferential direction of the tube, which finally breaks the tube when the tensile stress exceeds the tensile strength in the circumferential direction thereof. While a tensile strength in the circumferential direction of a tube (σT) affects a breaking pressure thereof, the tensile strength in the circumferential direction is normally smaller than a tensile strength in the longitudinal direction thereof (σL) and a ratio of σT/σL differs depending on its material (composition) of the tube; therefore, it is believed that an actual breaking pressure differs from a breaking pressure determined by the above equation depending on its material of the tube. Due to this, a thickness of a tube is determined by multiplying the breaking pressure by an excessive safety factor of S, when calculating the thickness of the tube.

In the case of a conventional phosphorus deoxidized copper tube, it is necessary for a tensile strength in the circumferential direction of the tube (σT) to be increased in order to improve its breaking pressure; however, because the phosphorus deoxidized copper tube has a small ratio of the tensile strength in the longitudinal direction of the tube (σL) to the tensile strength in the circumferential direction of the same (σT), σT/σL, it is necessary for the tube to be subjected to deformation processing. However, after being subjected to deformation processing, the tensile strength in the longitudinal direction of the tube (σL) also rises; and with that, the ductility of the tube is deteriorated, resulting in a defect that a bent portion of the tube has a crack in the bending processing when assembling a heat exchanger.

Accordingly, if an alloy tube with a large ratio of σT/σL is employed, it is ensured that a higher breaking pressure (pressure-resistant strength)is secured, a thickness of the tube can be thinner, and the tube is improved in its bending workability, because a tensile strength in the circumferential direction is higher even when a tensile strength in the longitudinal direction is the same.

Hereinafter, a reason for adding the ingredients into a heat transfer tube for a heat exchanger according to the present invention, and a reason for limiting the compositions thereof, will be described below.

"Sn: 0.1 to 2.0 Mass %"

In the copper alloy tube according to the present invention, because Sn has advantages in that it improves a tensile strength, an elongation, and the heat resistance of the tube, and suppresses the grain size coarsening; therefore, a thickness of the tube can be thinner than that of a phosphorus deoxidized copper tube. With Sn contained, a ratio of σT/σL can be larger than that of the phosphorus deoxidized copper, which enables the tube to be thinner compared to the phosphorus deoxidized copper tube having the identical σL. When an Sn content in a copper alloy tube exceeds 2.0 mass %, a coefficient of thermal conductivity, a requirement for a heat transfer tube, is decreased and the electrical conductivity is below 35 IACS %. Further, when an Sn content exceeds 2.0 mass %, solidification segregation in an ingot becomes so intense that the segregation sometimes is not completely cleared by the normal hot extrusion and/or thermomechanical processing, causing the metal structure, mechanical properties, bending workability, and the structure and mechanical properties after brazing, of the copper alloy tube, to be non-uniform. Further, an extrusion pressure is increased, therefore, an extrusion temperature is needed to be higher in order for the tube to be extrusion molded at the same extrusion pressure as with a copper alloy tube having an Sn content of 2 mass % or less. Due to this, surface oxidation of the extruded material is increased, causing the productivity to be decreased and surface defects of the copper alloy tube to be increased. Because problems become serious in terms of the heat transfer property and production, the upper limit of an Sn content should be 2.0 mass %. On the other hand, when Sn is contained in an amount of 0.1 mass % or less, a sufficient tensile strength and a small grain diameter cannot be obtained after annealing and brazing heating. Therefore, an Sn content should be 0.1 to 2.0 mass %, preferably 0.15 to 1.5 mass %, more preferably, 0.25 to 1.0 mass %.

"P: 0.005 to 0.1 Mass %"

In the copper alloy tube according to the present invention, addition of P is effective to prevent oxidization of Sn; however, when a P content exceeds 0.1 mass %, a crack is easy to occur at the time of hot extrusion, causing the sensitivity for stress corrosion cracking to be enhanced and a coefficient of thermal conductivity to be greatly decreased. When a P content is below 0.005 mass %, an Sn oxide is generated because an amount of oxygen is increased due to a shortage of deoxidation, causing the soundness of an ingot and the bending workability as a copper alloy tube to be deteriorated. Therefore, a P content should be 0.005 to 0.1 mass %, preferably 0.01 to 0.07 mass %, more preferably 0.04 to 0.05 mass %.

"S: 0.005 Mass % or Less"

In the copper alloy tube according to the present invention, S contained therein is present in the mother phase after forming a compound with Cu. When an S content is increased as a mixing rate of a low-grade copper ingot or scrap copper, etc. used as a material, is increased, casting cracks generated during casting ingots and cracks generated during hot extrusion are increased. Even if a crack generated during the hot extrusion is not present, a Cu—S compound in the material tends to extend in the tube axial direction, causing a crack to be easily generated at the interface between the copper alloy mother phase and the Cu—S compound, when the extruded material is subjected to the cold-rolling or the drawing processing. The cracks generated at the interface grow into surface flaws and surface cracks, causing the yield of products to be decreased. Even if a crack is not generated at the Cu—S compound interface, the interface tends to be a starting point of occurrence of cracks, causing cracks at a bent portion to frequently be generated, and a breaking pressure and a fatigue strength of the tube to be decreased, when the alloy tube according to the present invention is subjected to bending processing. In order to solve such problems, an S content in the copper alloy tube according to the present invention should be 0.005 mass % or less, preferably 0.003 mass % or less, more preferably 0.0015 mass % or less. S is relatively easy to be taken into a molten metal from materials, such as a copper ingot and scrap copper, oil adhering to the scrap copper, and the melting and casting atmosphere (charcoal/flux covering a molten metal, $SO_x$ gas in the atmosphere in contact with the molten metal, and a furnace material, etc.); therefore, the following measures are effective for an S content to be 0.005 mass % or less: amounts of a low-grade Cu ingot and scrap copper are reduced; an amount of $SO_x$ gas in the melting atmosphere are reduced; an appropriate furnace material is selected; and an element with potent affinity for S, such as Mg and Ca, is added into the molten metal in a minute amount. Further, elements other than S of As, Bi, Sb, Pb, Se, and Te, also deteriorate the soundness of an ingot, an extruded material, and a cold-rolled material, and impair its bending workability of a tube; therefore, it is preferable for a total amount of these elements to be 0.0015 mass % or less, preferably 0.0010 mass % or less, more preferably 0.005 mass % or less.

"O: 0.005 Mass % or Less"

In the copper alloy tube according to the present invention, when an O content exceeds 0.005 mass %, an oxide of Cu or Sn is taken into an ingot, causing the soundness of the ingot to be deteriorated and its bending workability of the tube produced to be easily deteriorated, and further the breaking pressure and the fatigue strength of the tube are decreased; therefore, an O content should be 0.005 mass % or less. In order for the bending workability of the tube to be more improved, an O content is preferably 0.003 mass % or less, more preferably 0.0015 mass % or less.

"H: 0.0002 Mass % or Less"

When an amount of hydrogen taken into a molten metal at the time of melting and casting the metal is larger, hydrogen generated by a decreased amount of solid solution at the time of solidification, is precipitated at the grain boundary in an ingot, causing many pinholes to be formed and a crack to be generated at hot extrusion. Because the hydrogen is precipitated at the grain boundary of an ingot, the inverse segregation of Sn and P becomes intense, causing a crack and a surface flaw to be easily generated at the hot extrusion of the ingot. Further, when an copper alloy tube subjected to rolling processing and drawing processing, is annealed after being extruded, hydrogen is condensed at the grain boundary when being annealed, causing a blister to be easily generated; thereby, the yield of products is decreased. Therefore, in the copper alloy tube according to the present invention, an H content should be 0.0002 mass % or less. An H content is preferably to be 0.0001 mass % or less in order for the yield of products to be more improved.

For an H content to be 0.0002 mass % or less, the following measures are effective: a material is dried at the time of melting and casting the metal; the charcoal covering the molten metal is red-hot; a dew point of the atmosphere in contact with the molten metal is reduced; and a molten metal is slightly oxidized prior to addition of phosphor.

"Zn: 0.01 to 1.0 Mass %"

A copper alloy tube can be improved in its strength, heat resistance, and fatigue strength by adding Zn therein, without its coefficient of thermal conductivity being greatly decreased. Adding Zn also contributes to the wear-reduction of a tool used for the processing of cold-rolling, drawing, and form rolling or the like, leading to an advantage in that a drawing plug and a grooved plug or the like can be used for a longer time; thereby a production cost can be reduced. In the copper alloy tube according to the present invention, Sn contained therein is oxidized to form an Sn oxide on the surface of the tube during the thermomechanical processing, such as the hot extrusion, heat treatment, and deformation processing. It is believed that a tool, such as a drawing plug and a grooved plug, is worn, because the Sn oxide is far harder than the Cu mother phase and the Cu oxide. A mechanism by which the wear of a tool is suppressed by addition of Zn is not clear; however, it can be estimated that: when the copper alloy tube is subjected to the heat treatment and deformation processing, a Zn oxide is preferentially oxidized on the surface of the alloy tube, because Zn contained in the copper alloy tube is more easily oxidized than Sn, thereby an amount of a generated Sn oxide is reduced; and a wear amount of the tool is reduced because the Zn oxide is soft. When a Zn content exceeds 1.0 mass %, the sensitivity for stress corrosion cracking is enhanced. On the other hand, when a Zn content is 0.01 mass % or less, the above advantages cannot be fully obtained. Accordingly, a Zn content should be 0.01 to 1.0 mass %. Additionally, advantages in that the strength, heat resistance, and fatigue strength of the tube are improved, and a wear amount of a tool is reduced, can be demonstrated by containing Mg in conjunction with Zn or instead of Zn. When solely containing Mg, an Mg content is preferably to be 0.01 to 0.2 mass %; and when containing Mg in conjunction with Zn, a total amount of Zn and Mg is preferably to be 0.02 to 1.0 mass %. Mg is easy to be oxidized, and when a rough surface or a crack on the surface of an ingot and an intermediate inside an ingot are caused by an Mg oxide, a flaw is generated on the surface of the tube during the processing of the hot extrusion, hot-rolling, and drawing, or the like, causing the yield of products to be decreased. Therefore, it is needed to control the melting and casting atmosphere and devise covering the surface of the molten metal by the charcoal or flux such that Mg is prevented from being oxidized, and a generated Mg oxide is not taken into an ingot during the melting and casting process.

A reason for limiting the characteristics, etc. of the copper alloy tube according to the present invention, will be described below.

"Tensile Strength: 250 N/mm$^2$ or more"

Many fin and tube type heat exchangers generally employ soft copper tubes, in particular, copper tubes after annealing (in a state of complete recrystallization). In the copper alloy tube according to the present invention, when its tensile strength thereof is below 250 N/mm$^2$ in a state of being annealed, the tube is insufficient in its strength when incorporated in a heat exchanger, such as an air-conditioner, and its strength after brazing cannot be fully maintained. It is noted that the tensile strength described herein is one in the tube axial direction of the copper alloy tube which has been made to a soft material by annealing.

"Average Grain Diameter in the Direction Perpendicular to the Thickness Direction of the Tube, in the Cross Section Perpendicular to the Tube Axis: 30 μm or Less"

When a hydrostatic pressure is exerted inside the tube, forces are exerted in the circumferential direction and the direction perpendicular to the thickness direction of the tube, in the cross section perpendicular to the tube axis, causing a crack to be generated from a point where a defect: such as a surface flaw on the outer surface inside the tube; an intermediate, such as a sulfide, inside the tube; and a micro crack on the inner surface or inside the tube. Propagation of such a crack causes the tube to be broken. The present inventor et al. have found that, to prevent a problem causing such breakage of the tube from being generated, it is effective that an average grain diameter in the direction perpendicular to the thickness direction of the tube, in the cross section perpendicular to the tube axis, is 30 μm or less. When the above average grain diameter exceeds 30 μm, a crack is easily to be generated at a bent portion at the time of being subjected to bending processing when incorporating it in a heat exchanger, such as an air conditioner or the like. In this case, the average grain diameter in the direction perpendicular to the thickness direction, is preferably 20 μm or less, more preferably 15 μm or less.

The average grain diameter may be satisfied in a state of being recrystallized by annealing, or in a state of being subjected to the deformation processing, such as the drawing processing.

"Assuming That a Tensile Strength in the Longitudinal Direction of the Copper Alloy Tube is σL, and a Tensile Strength in the Circumferential Direction of the Same is σT, σT/σL>0.93 Holds."

As described above, a tensile strength in the circumferential direction of a tube (σT) is smaller than a tensile strength in the longitudinal direction of the same (σL), and a breaking pressure of a tube is associated with σT; therefore, it is advantageous that a value of σT/σL is larger to make a breaking pressure of the tube larger. While a usual phosphorus deoxidized copper tube has a value of σT/σL of about 0.89 to 0.91, the copper alloy tube according to the present invention has a value of σT/σL of more than 0.93, enabling a breaking pressure of the tube to be improved without the tensile strength of a material being greatly enhanced. When σ/σL≤0.93, a tensile strength in the longitudinal direction should be enhanced in order to satisfy a predetermined breaking pressure with the same thickness thereof, causing its workability of the tube to be greatly impaired. With σT/σL>0.93 being satisfied, a higher breaking pressure of the alloy tube is secured while maintaining its good bending workability or the like, enabling a thickness of the tube to be thinner and a heat exchanger to be lighter. While σT/σL>0.93 holds in the present invention, it is more preferable that σT/σL>0.95 holds. When σLs are the same, the copper alloy tube according to the present invention has a higher breaking pressure. And, when the materials have the same breaking pressures, the copper alloy tube according to the present invention less frequently has a crack caused by the bending processing of the tube, enabling the tube of the present invention to be subjected to more strict bending (bending with a smaller bending radius) to be performed. When the copper alloy tube according to the present invention is produced through the processes of casting-hot extrusion-rolling-drawing-annealing, the following factors should be controlled appropriately in order for σT/σL>0.93 to hold in a state of being annealed. Those factors are: a temperature of the hot extrusion; a processing rate in the hot extrusion; a cooling rate after the hot extrusion; processing rates in the rolling process and drawing process; a temperature of annealing; and a heating rate when annealing it. Assuming that the process conditions between, for example, the hot extrusion process and the drawing process, are within the same limits, a value of σT/σL becomes larger as a heating rate at the time of annealing is larger.

"Tensile Strength is 280 N/mm$^2$ or more in a State of Being Subjected to the Drawing Processing, and an Average Grain Diameter, which is Measured in the Direction Perpendicular to the Thickness Direction of the Tube in the Cross Section Perpendicular to the Tube Axis, is 30 μm or Less."

A fin and tube type heat exchanger is produced with a heat transfer tube being subjected to the bending processing and extending processing, etc. Because an annealed material is soft and easy to be deformed, there is sometimes unexpected deformation generated in a heat transfer tube, when performing the bending processing or extending processing on the tube, or when conveying or handling the tube. To solve this problem, a so-called semi-rigid material, of which strength is a little enhanced by performing the drawing processing on an annealed material, is sometimes used. When a tensile strength in the longitudinal direction of a copper alloy tube is below 280 N/mm$^2$, the aforementioned purpose for preventing the deformation from being generated, cannot be attained. On the other hand, when an above average grain diameter in the direction perpendicular to the thickness of the tube in the cross section perpendicular to the tube axis, exceeds 30 μm, a crack is easily to be generated at a bent portion when the tube is subjected to the bending processing to incorporate it into a heat exchanger for an air conditioner or the like. Accordingly, it is preferable that a tensile strength of the tube is 280 N/mm$^2$ or more, and an average grain diameter in the direction perpendicular to the thickness direction of the tube, in the cross section perpendicular to the tube axis, is 30 μm or less, in a state of being subjected to the drawing processing. It is necessary that the deformation processing, such as the bending or extending processing, can be performed successfully also on a semi-rigid material; and to make it possible, an elongation in the longitudinal direction of the copper tube, which has been subjected to the drawing processing, is 25% or more, preferably 30% or more, more preferably 35% or more, when the tube is subjected to a tensile test.

"Total Amount of Fe, Ni, Mn, Mg, Cr, Ti, and Ag: 0.005 to 0.07 Mass %"

Each of Fe, Ni, Mn, Mg, Cr, Ti, Zr, and Ag improves a strength, a pressure-resistant breaking strength, and the heat resistance of the copper alloy according to the present invention and makes a grain size finer, leading to the improved bending workability. When a content of one or more elements selected from the aforementioned elements exceeds 0.07 mass %, the extrusion pressure rises; therefore, it is needed to increase an temperature of the hot extrusion, if a material containing these elements is to be extruded with the same extrusion power as with a material without these elements. Due to this, the surface of the extruded material is more oxidized, causing many surface defects to be generated and the yield of products to be decreased, in the copper alloy tube according to the present invention. Accordingly, an amount of one or more elements selected from the group consisting of Fe, Ni, Mn, Mg, Cr, Ti, Zr, and Ag, is preferably 0.07 mass % or less, more preferably 0.05 mass % or less, still more preferably 0.03 mass % or less.

"Average Grain Diameter in the Direction Perpendicular to the Thickness Direction of the Tube, in the Cross Section Perpendicular to the Tube Axis, after Heating the Tube to 800° C. for 15 Seconds: 100 μm or Less"

As mentioned above, when processed into an heat exchanger, a copper alloy tube is affected by the brazing heat, causing a grain size thereof to be coarsened. When an average grain diameter in the direction perpendicular to the thickness direction of a tube, in the cross section perpendicular to the tube axis, exceeds 100 μm after being heated to 800° C. for 15 seconds, which affects the tube at the same level as with the brazing heat, the breaking pressure is greatly decreased at a brazing area; causing the reliability of an heat exchanger to be deteriorated, when the copper alloy tube is employed in a heat exchanger for the HFC-type fluorocarbon refrigerant and the carbon dioxide refrigerant, the heat exchanger being run in a higher operation pressure. Accordingly, an average grain diameter in the direction perpendicular to the thickness direction of the tube, in the cross section perpendicular to the tube axis, is 100 μm or less, preferably 60 μm or less.

"Copper Alloy Tube is an Inner Grooved Tube."

The copper alloy tube according to the present invention can be increased in its tensile strength and elongation and can be small in its grain diameter compared to the phosphorus deoxidized copper tube; therefore, the tube is suitable for producing an inner grooved tube by using the form rolling processing. Because the copper alloy tube of the present invention is difficult to extend in the drawing direction while being subjected to the form rolling processing because of its high tensile strength, in particular; therefore, the alloy can be smoothly filled into a groove portion of a grooved plug without breaking the tube even when a drawing force at the time of the form rolling is large. Therefore, an inner grooved tube having a good fin shape can be processed at a high speed.

Taking the case of a smooth tube or an inner grooved tube as an example, an example of methods of producing the copper alloy tube according to the present invention, will be described below.

A material of the electrolytic copper is at first melted in a state of being covered with the charcoal. After the copper is melted, predetermined amounts of Sn and, as necessary, Zn are added therein, and P is further added as an intermediate alloy of Cu-15 mass % P, also for the purpose of deoxidation. Upon completion of the ingredient adjustment, a billet with a predetermined size is produced by using the semi-continuous casting. The obtained billet is heated in a heating furnace to be subjected to the homogenization processing. Processing for improving the segregation is preferably performed by the homogenization with the billet held at a temperature of 750 to 950° C. for about 1 minute to 2 hours, prior to the hot-extrusion.

The billet is then subjected to the perforation processing by piercing and is hot extruded at a temperature of 750 to 950° C. Clearance of the segregation of Sn and refinement of the structure of a produced tube are essential requirements for producing the copper alloy tube according to the present invention; and to make it possible, a reduction rate of the cross section area ([a donut-shaped area of the perforated billet—a cross section area of an base tube after being hot extruded]/[a donut-shaped area of the perforated billet]×100%) should be 88% or more, preferably 93% or more. Moreover, the base tube after being hot extruded is preferably cooled by water cooling, etc., such that a cooling rate at which the base tube is cooled to 300° C., is 10° C./sec or more, preferably 15° C./sec or more, still more preferably 30° C./sec or more.

The extruded base tube is then subjected to the rolling processing to reduce its outer diameter and thickness. At the time, with a processing rate being 92% or less in terms of a reduction rate of the cross section area, defective products can be reduced during the drawing processing.

A base tube with a predetermined size can be produced by performing the drawing processing on the extruded base tube. The drawing processing is usually performed by using a plurality of drawing machines, and with a processing rate (reduction rate of the cross section area) by each drawing machine being 35% or less, surface flaws and inner cracks in an base tube can be reduced.

After that, when a customer provides a soft smooth tube or produces an inner grooved tube using a drawn tube, a drawn tube processed to have a predetermined size is subjected to the annealing processing. When continuously annealing the copper alloy tube according to the present invention, a roller hearth furnace typically used for annealing a copper tube coil, etc., or a high-frequency induction coil through which a copper tube is passed while supplying power to the high-frequency induction coil, can be used to heat the copper tube. In order to produce the copper alloy tube according to the present invention by using the roller hearth furnace, a drawn tube is preferably annealed so that the tube is heated to its substantial temperature of 400 to 700° C. for about 1 to 120 minutes. In addition, the tube is preferably heated from room temperature to a predetermined temperature at an average heating rate of 5° C./min or more, preferably 10° C./min or more, more preferably 30° C./min or more.

When the substantial temperature of the drawn tube is below 400° C., a completely recrystallized structure cannot be obtained (a fibrous processed structure remains) in the drawn tube, causing the bending processing and the processing on the inner grooved tube by a customer to be difficult to be performed. On the other hand, when the substantial temperature exceeds 700° C., a grain size is coarsened and the bending workability of the tube is rather deteriorated; and in processing an inner grooved tube, because a tensile strength of the tube is decreased, the tube extends greatly in the longitudinal direction of the tube axis; therefore, a fin inside the tube is difficult to be formed so as to have a right shape. Accordingly, the drawn tube is preferably annealed at a substantial temperature of 400 to 700° C. In addition, when a heating time within the temperature range is shorter than 1 minute, a completely recrystallized structure cannot be acquired, causing the aforementioned problems to arise. On the other hand, when annealing the tube for more than 120 minutes, there is no change in the grain size and the effect of annealing is saturated; therefore, a heating time within the aforementioned temperature range is preferably 1 to 120 minutes. In order to prevent a grain size from being coarsened, an average heating rate from room temperature to a predetermined temperature, is preferably faster. When a heating rate is slower than 5° C./min, a grain size is apt to be coarsened even if heated to the same temperature, which is not preferable in terms of a pressure-resistant breaking strength and the bending workability, and also impairs the productivity. Accordingly, an average heating rate from room temperature to a predetermined temperature is preferably 5° C./min or more, more preferably 10° C./min or more, still more preferably 30° C./min or more.

The tube may be annealed at a faster heating rate and a faster cooling rate, and heated for a shorter time, by using the high-frequency induction heating furnace instead of the continuous annealing using the above roller hearth furnace. A method of producing a smooth tube has been described above. A smooth tube thus produced may be subjected to the drawing processing with various processing rates, as necessary, so that a processed tube having an improved strength is produced.

In the case of an inner grooved tube, an annealed smooth tube is subjected to the groove form rolling processing. An inner grooved tube thus produced is usually further subjected to the annealing processing so that the tube can be subjected to the bending processing and extending processing. An inner grooved tube thus annealed may be subjected to the drawing processing with a small processing rate, as necessary, so that the tube has an improved tensile strength.

EXAMPLES

Test results for proving effects of the present invention will be described below.

Example 1

Smooth Tube (a) A molten metal having a predetermined composition was produced in the following steps: a predetermined amount of Sn was added in a molten metal made by the electrolytic copper being a raw material; Zn was further added thereto, as necessary; and a Cu—P mother alloy was added thereto. At the time, a Cu—Sn—P mother alloy can also be employed instead of Sn and the Cu—P mother alloy.

(b) An ingot with its diameter of 320 mm and length of 6500 mm was semi-continuously cast at a casting temperature of 1200° C.

(c) A billet with its length of 450 mm was cut out from the obtained ingot.

(d) After heating the billet to 650° C. with a billet heater and further heating to 850 to 900° C. with an induction heater, the billet was subjected to the piercing processing 2 minutes after the billet reached the temperature, by using an hot extruder so as to have a hole with a diameter of 80 mm in its center. After that, an extruded base tube with its outer diameter of 96 mm and thickness of 9.5 mm, was produced by the hot extrusion (reduction rate of the cross section area: 96.6%). An average cooling rate up to 300° C. of the extruded base tube was 40° C./sec.

(e) The extruded base tube was rolled so as to make a rolled base tube with its outer diameter of 35 mm and thickness of 2.3 mm.

(f) The rolled base tube was repeatedly subjected to the drawing processing so as for a reduction rate of the cross section area in each drawing processing to be 35% or less, and a copper alloy tube level wound coil with its outer diameter of 9.52 mm and thickness of 0.80 mm was obtained.

(g) The drawn tube level wound coil was heated to 450 to 600° C. (average heating rate: 10 to 35° C./min) in a reducing gas atmosphere in an annealing furnace to be held at the temperature for 30 to 120 minutes; then was cooled to room temperature through a cooling zone to make a specimen. An average cooling rate from the heating temperature to room temperature was 15 to 40° C./min.

Table 1 shows characteristics of the annealed smooth tube with its outer diameter of 9.52 mm and thickness of 0.80 mm. The tensile strengths in the longitudinal and circumferential directions of the tube, shown in Table 1, were obtained from a tensile test using specimens for the test which were made in the following steps: the tube prior to annealing was made flat by marking cut lines on the tube in the longitudinal direction and opening it; and sheet materials were cut out in the longitudinal and circumferential directions of the tube to make specimens for tensile test with a length of 29 mm and a width of 10 mm. The shape of the specimens was illustrated in FIG. 1. In FIG. 1, the numerals show a size (mm) of each portion of the specimen. The specimens were then inserted in an annealing furnace after putting them on each copper alloy tube level wound coil to anneal the specimens and the each copper alloy tube level wound coil under the same conditions. After annealing, the tensile strengths in the longitudinal and the circumferential directions of the tube, were measured by using the 5566 universal testing machine manufactured by Instron Corp. To check whether, when the tube was cut out and made flat, any influence generated by the deformation processing was exerted on the specimen, the specimen as is a circular tube and the specimen cut out and made flat, were annealed together in the aforementioned way, and subsequently were measured for hardness of the cross sectional portion (portion subjected to the bending and stretching processing with respect to the latter specimen) and the surface portion (portion subjected to the bending and stretching processing with respect to the latter specimen) of each specimen. As a result, both specimens demonstrated the same value, and the grain sizes of the cross sections thereof were also the same. From the results, it was determined that the processing in which the tube was cut open and made flat did not affect its tensile strength, therefore, the measurement for tensile strength by the above method expressed the tensile strength in a state of a circular tube.

TABLE 1

| No. | | Components | | | | | | | | Tensile strength in the longitudinal direction $\sigma_L$ ($N/mm^2$) |
|---|---|---|---|---|---|---|---|---|---|---|
| | | Cu (wt %) | Sn (wt %) | S (ppm) | P (wt %) | Zn (wt %) | Fe, Ni, Mn, Mg, Cr, Ti and Ag (wt %) | O (ppm) | H (ppm) | |
| Examples | 1 | remainder | 0.15 | 5 | 0.010 | — | — | 20 | 0.9 | 253 |
| | 2 | remainder | 0.30 | 10 | 0.020 | — | — | 15 | 0.8 | 261 |
| | 3 | remainder | 0.63 | 20 | 0.027 | — | Fe: 0.012 | 13 | 0.6 | 278 |
| | 4 | remainder | 0.65 | 10 | 0.025 | — | — | 17 | 0.7 | 279 |
| | 5 | remainder | 0.65 | 30 | 0.027 | 0.12 | Cr: 0.015 | 21 | 0.8 | 279 |
| | 6 | remainder | 0.68 | 15 | 0.030 | 0.15 | Ti: 0.01, Ni: 0.005 | 18 | 0.5 | 280 |
| | 7 | remainder | 0.70 | 20 | 0.018 | 0.20 | — | 15 | 0.4 | 281 |
| | 8 | remainder | 0.90 | 25 | 0.025 | 0.35 | Mn: 0.02 | 15 | 0.5 | 292 |
| | 9 | remainder | 0.95 | 30 | 0.025 | 0.37 | Mg0.05 | 23 | 0.6 | 294 |
| | 10 | remainder | 1.50 | 5 | 0.022 | — | — | 20 | 0.5 | 323 |
| | 11 | remainder | 1.90 | 35 | 0.020 | — | — | 21 | 0.7 | 343 |
| Comparative Examples | 1 | remainder | 0.65 | 10 | 0.025 | — | — | 17 | 0.7 | 279 |
| | 2 | remainder | 0.05 | 20 | 0.022 | — | — | 22 | 0.6 | 248 |
| | 3 | remainder | 3.0 | 15 | 0.025 | — | — | 25 | 0.8 | — |
| | 4 | remainder | 0.60 | 90 | 0.020 | — | — | 20 | 0.7 | — |
| | 5 | remainder | 0.63 | 20 | 0.3 | — | — | 10 | 0.5 | 278 |
| | 6 | remainder | 0.65 | 10 | 0.018 | 3.0 | — | 18 | 0.4 | 279 |
| | 7 | remainder | 0.64 | 5 | 0.020 | — | — | 120 | 1.1 | 278 |
| | 8 | remainder | 0.60 | 25 | 0.022 | — | — | 25 | 6 | — |
| Conventional Example | 1 | remainder | — | — | 0.022 | — | — | 15 | 0.6 | 245 |

| No. | | Tensile strength in the circumferential direction $\sigma_T$ ($N/mm^2$) | $\sigma_T/\sigma_L$ | Grain Diameter (mm) | Breaking Pressure (MPa) | Stress Corrosion Cracking Test | Hydrogen Embrittlement Test |
|---|---|---|---|---|---|---|---|
| Examples | 1 | 237 | 0.94 | 0.030 | 40 | ○ | ○ |
| | 2 | 249 | 0.95 | 0.030 | 43 | ○ | ○ |
| | 3 | 274 | 0.99 | 0.030 | 44 | ○ | ○ |
| | 4 | 276 | 0.99 | 0.025 | 44 | ○ | ○ |
| | 5 | 276 | 0.99 | 0.025 | 44 | ○ | ○ |
| | 6 | 278 | 0.99 | 0.020 | 44 | ○ | ○ |
| | 7 | 280 | 1.00 | 0.020 | 44 | ○ | ○ |
| | 8 | 296 | 1.01 | 0.015 | 45 | ○ | ○ |
| | 9 | 300 | 1.02 | 0.015 | 45 | ○ | ○ |
| | 10 | 343 | 1.06 | 0.010 | 46 | ○ | ○ |
| | 11 | 375 | 1.09 | 0.010 | 46 | ○ | ○ |
| Comparative Examples | 1 | 245 | 0.88 | 0.035 | 37 | ○ | ○ |
| | 2 | 229 | 0.93 | 0.040 | 38 | ○ | ○ |
| | 3 | — | — | — | — | — | — |
| | 4 | — | — | — | — | — | — |
| | 5 | 274 | 0.99 | 0.025 | 44 | x | ○ |
| | 6 | 276 | 0.99 | 0.035 | 44 | x | ○ |
| | 7 | 275 | 0.99 | 0.025 | 44 | ○ | x |
| | 8 | — | — | — | — | — | — |
| Conventional Example | 1 | 223 | 0.91 | 0.040 | 37 | ○ | ○ |

A specimen for a stress corrosion cracking test with its length of 75 mm was cut out from the tube, and after degreasing and drying, the specimen was put in a desiccator, in which 11.8% or more of ammonia solution which was made with ammonia specified by the JIS K 8085 diluted by an equivalent amount of pure water was placed, 50 mm apart from the surface of the solution, so that the specimen was held in the ammonia atmosphere at normal temperature for 2 hours; and subsequently, the specimen was crashed to 50% of the original outer diameter to visually observe a crack. The results were shown by o when there was no crack, and by x when there was a crack.

Furthermore, existence of embrittlement was checked with a treated specimen magnified 100 times by a microscope, the treated specimen being heated at 850° C. for 30 minutes in a hydrogen atmosphere, and subsequently being polished and etched. The results were shown by o when there was no embrittlement and by x when there was any embrittlement.

Comparative Example No. 3 had a high Sn content and the large deformation resistance, therefore a billet was heated to 950° C. and extruded. Accordingly, an oxide was taken in the surface thereof, causing many flaws to be generated on the surface of the drawn processed material. When a portion without a crack was annealed to measure its electrical conductivity, the value was greatly below the 26 IACS % and 35 IACS %. Because it was determined that it was difficult to be used as a heat transfer tube, measurements for tensile strength, grain size, and breaking pressure, etc., were not performed. Comparative Examples Nos. 4 and 8 had cracks while being hot extruded, thereby they were unable to be processed.

As shown in Table 1, Examples Nos. 1 to 11 had high tensile strengths, high breaking pressures, and no cracks in the stress corrosion cracking test and hydrogen embrittlement test. On the other hand, Comparative Example No. 1, which was tested at an annealing speed of 3° C./min, had a decreased tensile strength in the circumferential direction of a tube while having the same tensile strength in the longitudinal direction thereof compared to Example No. 4 of the present invention having the same composition as with Comparative Example No. 1, resulting in a failure to obtain a satisfactory breaking pressure. Comparative Examples Nos. 5 and 6 had cracks in the stress corrosion cracking tests because of greater P contents and Zn contents thereof than specified by the present invention, respectively, and Comparative Example No. 7 had a cracks in the hydrogen embrittlement test because of a greater O content than specified by the invention. Conventional Example had decreased tensile strengths and a breaking pressure.

Table 2 below shows properties of an annealed material of the smooth tube with its outer diameter of 9.52 mm and thickness of 0.80 mm, which was heated to 800° C. for 15 seconds. Measurements in Table 2 were obtained in a tensile test in the longitudinal direction of a tube, in a state of a tube.

TABLE 2

| No. | | Tensile Strength (N/mm$^2$) | Grain Diameter (mm) | Breaking Pressure (MPa) |
|---|---|---|---|---|
| Examples | 1 | 240 | 0.090 | 39 |
| | 2 | 245 | 0.070 | 42 |
| | 3 | 255 | 0.050 | 43 |
| | 4 | 260 | 0.040 | 43 |
| | 5 | 265 | 0.040 | 43 |
| | 6 | 270 | 0.040 | 43 |
| | 7 | 265 | 0.040 | 43 |
| | 8 | 290 | 0.025 | 44 |
| | 9 | 290 | 0.025 | 44 |
| | 10 | 315 | 0.020 | 45 |
| | 11 | 330 | 0.020 | 45 |
| Comparative Examples | 1 | 240 | 0.110 | 39 |
| | 2 | 230 | 0.150 | 37 |
| | 3 | — | — | — |
| | 4 | — | — | — |
| | 5 | — | — | — |
| | 6 | — | — | — |
| | 7 | — | — | — |
| | 8 | — | — | — |
| Conventional Example | 1 | 230 | 0.150 | 37 |

Comparative Examples Nos. 4 to 8 were not tested because specimens could not be made from Comparative Examples Nos. 3, 4 and 8, and Comparative Examples Nos. 5, 6, and 7 had defects in the stress corrosion cracking test and hydrogen embrittlement test.

As shown in Table 2, Example Nos. 1 to 11 had high tensile strengths and high breaking pressures after the annealed materials were heated to 800° C. for 15 seconds. On the other hand, Comparative Examples Nos. 1 and 2 had lower values thereof. Separately, the rolled base tubes of Example No. 4 (Sn: 0.65 mass %, P: 0.025 mass %), Example No. 7 (Sn: mass %, P: 0.018 mass %, Zn: 0.20 mass %), and example No. 9 (Sn: 0.95mass %, P: 0.025mass %, Zn: 0.37 mass %, Mg: 0.04mass %) were subjected to the drawing processing (lengths of the drawn tubes: 1000 mm), and wear situations of the drawing plugs used in the drawing processing (the plugs were inserted inside the tubes and held at the positions of dices which the outer surfaces of the tubes contacted)were observed by using an optical microscope. As a result, the wear depth of the plug used in the drawing processing of Example No. 4 was the largest, and those of the plugs used in Examples No. 7 and 9 were considerably small. Accordingly, it is understood that Zn and Mg contribute to the drastic decrease in the depth wear of a drawing plug.

Example 2

Semi-Rigid Tube

The processes of (a) through (g) are the same as those of the above smooth tube, with an exception that, in (f), the semi-rigid tube had its outer diameter of 10.6 mm and thickness of 0.79 mm in order for the final size of the semi-rigid tube to be matched.

(h) Subsequently, the annealed tube was made into a specimen after being subjected to the drawing processing so as to have its outer diameter of 9.52 mm and thickness of 0.80 mm, by being sunk with a dice at a processing rate of 10%. Table 3 below shows the properties of a semi-rigid tube having its outer diameter of 9.52 mm and thickness of 0.80 mm, and Table 4 below similarly shows the properties of the semi-rigid tube which was heated to 800° C. for 15 seconds. Measurements in Table 3 were obtained in the tensile tests in the longitudinal direction, in a state of a tube.

TABLE 3

| No. | | Components | | | | | | | | Tensile Strength (N/mm$^2$) $\sigma_L$ | Grain Diameter (mm) | Breaking Pressure (MPa) | Stress Corrosion Cracking Test | Hydrogen Embrittlement Test |
|---|---|---|---|---|---|---|---|---|---|---|---|---|---|---|
| | | Cu (wt %) | Sn (wt %) | S (ppm) | P (wt %) | Zn (wt %) | Fe, Ni, Mn, Mg, Cr, Ti and Ag (wt %) | O (ppm) | H (ppm) | | | | | |
| Examples | 12 | remainder | 0.63 | 20 | 0.027 | — | Fe: 0.012 | 13 | 0.6 | 310 | 0.010 | 50 | ○ | ○ |
| | 13 | remainder | 0.65 | 10 | 0.025 | — | — | 17 | 0.7 | 315 | 0.010 | 50 | ○ | ○ |
| | 14 | remainder | 0.65 | 30 | 0.027 | 0.12 | Cr: 0.015 | 21 | 0.8 | 315 | 0.010 | 50 | ○ | ○ |
| | 15 | remainder | 0.68 | 15 | 0.030 | 0.15 | Ti: 0.01, Ni: 0.005 | 18 | 0.5 | 320 | 0.010 | 51 | ○ | ○ |
| Comparative Example | 9 | remainder | 0.05 | 20 | 0.022 | — | — | 22 | 0.6 | 275 | 0.015 | 42 | ○ | ○ |
| Conventional Example | 1 | remainder | — | — | 0.022 | — | — | 15 | 0.6 | 275 | 0.015 | 42 | ○ | ○ |

TABLE 4

| No. | | Tensile Strength (N/mm$^2$) $\sigma_L$ | Grain Diameter (mm) | Breaking Pressure (MPa) |
|---|---|---|---|---|
| Examples | 12 | 295 | 0.025 | 48 |
| | 13 | 290 | 0.020 | 47 |

TABLE 4-continued

| No. | | Tensile Strength ($N/mm^2$) $\sigma_L$ | Grain Diameter (mm) | Breaking Pressure (MPa) |
|---|---|---|---|---|
| | 14 | 295 | 0.020 | 48 |
| | 15 | 300 | 0.020 | 50 |
| Comparative Example | 9 | 260 | 0.070 | 36 |
| Conventional Example | 1 | 260 | 0.070 | 36 |

As shown in Table 3, also in the semi-rigid tube, Examples No. 12 to 15 had high tensile strengths and high breaking pressures, and no cracks in the stress corrosion cracking test and the hydrogen embrittlement test. Moreover, as shown in Table 4, the semi-rigid annealed tube also had sufficiently high tensile strengths and breaking pressures after being heated to 800° C. for 15 seconds. On the other hand, Comparative Example No. 9 and Conventional Example No. 1 had low tensile strengths and breaking pressures.

Example 3

Inner Grooved Tube

The processes of (a) through (e) were the same as those of the above smooth tube.

(i) Subsequently, the hot-rolled base tube was subjected to the drawing process to make a grooved base tube for rolling.

(j) The grooved base tube for rolling was subjected to an intermediate annealing by using an induction heater.

(k) The grooved base tube for rolling, which had been subjected to the intermediate annealing, was subjected to the rolling processing with groove to make an inner grooved tube having its outer diameter of 9.52 mm and bottom thickness of 0.28 mm. The inner grooved tube had its fin height of 0.16 mm, its lead angle of 35°, and the number of its fin peaks of 55.

(l) An inner grooved tube was held in a reducing gas having a temperature of 550 to 650° C. for 60 to 120 minutes when passing through a heating zone, and was subsequently cooled to room temperature through a cooling zone.

Table 5 below shows the properties of the annealed inner grooved copper alloy tube having its outer diameter of 9.52 mm and bottom thickness of 0.28 mm; and Table 6 similarly shows the properties of the annealed tube of the same after heating it to 800° C. for 15 seconds. The tensile strengths in the longitudinal and circumferential directions of the tube in Table 5, were obtained in the process described below: the tube prior to annealing was made flat by marking cut lines on the tube in the longitudinal direction and opening it; sheet materials subsequently were cut out in the longitudinal and circumferential directions of the tube to make specimens for tensile test with its length of 29 mm and width of 10 mm; the specimens were annealed in an annealing furnace; and the tensile strengths in the longitudinal and circumferential directions of the tube were measured by using a micro tensile tester. To check whether the deformation processing in which the tube was cut out and made flat affected the tensile strengths, the tube and the materials cut out from the tube and made flat, were both measured for their hardness in their cross-sectional portions, after annealing the both. As a result, the both showed the same value. Therefore, it was determined that the deformation processing in which the tube was cut out and made flat did not affect the tensile strength. Measurements in Table 6 were obtained in the tensile tests in the longitudinal direction of the tube, in a state of a tube.

TABLE 5

| No. | | Components | | | | | | | | Tensile Strength in the Longitudinal Direction $\sigma_L$ ($N/mm^2$) |
|---|---|---|---|---|---|---|---|---|---|---|
| | | Cu (wt %) | Sn (wt %) | S (ppm) | P (wt %) | Zn (wt %) | Fe, Ni, Mn, Mg, Cr, Ti and Ag (wt %) | O (ppm) | H (ppm) | |
| Examples | 16 | remainder | 0.63 | 20 | 0.027 | — | Fe: 0.012 | 13 | 0.6 | 268 |
| | 17 | remainder | 0.65 | 10 | 0.025 | — | — | 17 | 0.7 | 270 |
| | 18 | remainder | 0.65 | 30 | 0.027 | 0.12 | Cr: 0.015 | 21 | 0.8 | 277 |
| | 19 | remainder | 0.68 | 15 | 0.030 | 0.15 | Ti: 0.01, Ni: 0.005 | 18 | 0.5 | 280 |
| Comparative examples | 10 | remainder | 0.05 | 20 | 0.022 | — | — | 22 | 0.6 | 238 |
| Conventional Example | 1 | remainder | — | — | 0.022 | — | — | 15 | 0.6 | 238 |

| No. | | Tensile Strength in the Circumferential Strength $\sigma_T$ ($N/mm^2$) | $\sigma_T/\sigma_L$ | Grain Diameter (mm) | Breaking Pressure (MPa) | Stress Corrosion Cracking Test | Hydrogen Embrittlement Test |
|---|---|---|---|---|---|---|---|
| Examples | 16 | 265 | 0.99 | 0.030 | 15 | ○ | ○ |
| | 17 | 267 | 0.99 | 0.025 | 15 | ○ | ○ |
| | 18 | 274 | 0.99 | 0.025 | 15 | ○ | ○ |
| | 19 | 277 | 0.99 | 0.020 | 16 | ○ | ○ |
| Comparative examples | 10 | 219 | 0.92 | 0.015 | 12 | ○ | ○ |
| Conventional Example | 1 | 218 | 0.92 | 0.015 | 12 | ○ | ○ |

TABLE 6

| No. | | Tensile Strength ($N/mm^2$) $\sigma_L$ | Grain Diameter(mm) | Breaking Pressure(MPa) |
|---|---|---|---|---|
| Examples | 16 | 250 | 0.050 | 14 |
| | 17 | 256 | 0.040 | 14 |

TABLE 6-continued

| No. | | Tensile Strength ($N/mm^2$) $\sigma_L$ | Grain Diameter(mm) | Breaking Pressure(MPa) |
|---|---|---|---|---|
| | 18 | 261 | 0.040 | 14 |
| | 19 | 265 | 0.040 | 17 |
| Comparative Example | 10 | 225 | 0.150 | 11 |
| Conventional Example | 1 | 225 | 0.150 | 11 |

As shown in Table 5, the inner grooved tubes of Examples Nos. 16 to 19 had high tensile strengths and high breaking pressures, and no cracks in the stress corrosion cracking test and the hydrogen embrittlement test. Also as shown in Table 6, the annealed semi-rigid material had sufficiently high tensile strengths and breaking pressures after being heated to 800° C. for 15 seconds. On the other hand, Comparative Example 10 and Conventional Example 1 had low tensile strengths and breaking pressures.

Example 4

Smooth Tube Produced by the Casting and Rolling Process

The casting and rolling process is a process in which a hollow billet casing machine, which melts copper and continuously casts a tube-shaped ingot of copper horizontally, and a planetary rolling mill (3 roll head planetary rolling mill) are combined to produce tubes. A continuously cast hollow billet ingot was rolled by a roll performing planetary rotation around the ingot to be processed into a base tube. Although this process has an advantage in that a copper base tube can be produced without an extrusion process, the process is applied only to the phosphorus deoxidized copper at present, because there is a fear that the casting segregation might remain or the structure of the tube might be nonuniform, due to the lack of an ingot heating process and a hot-rolling process for extrusion.

(m) A predetermined molten metal was produced by adding Sn in an original molten metal of electrolytic copper, a raw material, and by further adding Cu—P mother alloy. Subsequently, a base tube was produced by continuously casting the molten metal horizontally, and a rolled base tube with its outer diameter of 35 mm and thickness of 2.3 mm was further produced by rolling the outer surface of the tube with a planetary roll. A smooth copper alloy tube with its outer diameter of 9.52 mm and bottom thickness of 0.80 mm was produced by applying the processes following (f) process in Example 1, to the rolled base tube thus produced.

Table 7 below shows the composition and the properties of the smooth tube, and Table 8 similarly shows the properties after the annealed material was heated to 800° C. for 15 seconds. The tensile strengths in the longitudinal and circumferential directions of the tube in Table 7, were determined using specimens produced in the same way as with Example 1. Measurements in Table 8 were obtained in the tensile tests in the longitudinal direction of the tube, in a state of a tube.

TABLE 7

| No. | | 成分 Cu (wt %) | Sn (wt %) | S (ppm) | P (wt %) | Zn (wt %) | Fe, Ni, Mn, Mg, Cr, Ti and Ag (wt %) | O (ppm) | H (ppm) | Tensile Strength in the Longitudinal Direction $\sigma_L$ ($N/mm^2$) |
|---|---|---|---|---|---|---|---|---|---|---|
| Examples | 20 | remainder | 0.60 | 30 | 0.020 | — | — | 40 | 0.5 | 279 |
| Comparative example | 11 | remainder | 0.03 | 35 | 0.025 | — | — | 45 | 0.7 | 248 |
| Conventional Example | 1 | remainder | — | | 0.022 | — | — | 15 | 0.6 | 245 |

| No. | | Tensile Strength in the Circumferential Strength $\sigma_T$ ($N/mm^2$) | $\sigma_T/\sigma_L$ | Grain Diameter (mm) | Breaking Pressure (MPa) | Stress Corrosion Cracking Test | Hydrogen Embrittlement Test |
|---|---|---|---|---|---|---|---|
| Examples | 20 | 279 | 0.99 | 0.025 | 44 | ○ | ○ |
| Comparative example | 11 | 229 | 0.93 | 0.040 | 38 | ○ | ○ |
| Conventional Example | 1 | 226 | 0.92 | 0.040 | 37 | ○ | ○ |

TABLE 8

| No. | | Tensile Strength ($N/mm^2$) $\sigma_L$ | Grain Diameter (mm) | Breaking Pressure (MPa) |
|---|---|---|---|---|
| Examples | 20 | 276 | 0.040 | 43 |
| Comparative Example | 11 | 241 | 0.150 | 37 |
| Conventional Example | 1 | 238 | 0.150 | 35 |

As shown in Table 7, the smooth tube in Example 20 had high tensile strengths and high breaking pressure, and no cracks in the stress corrosion cracking test and the hydrogen embrittlement test. Also as shown in Table 8, the annealed smooth tube had sufficiently high tensile strength and breaking pressure after being heated to 800° C. for 15 seconds. On the other hand, Comparative Example 11 and Conventional Example 1 had low tensile strengths and breaking pressures. The copper alloy tube in Example 20 contains 0.60 mass % of Sn; however, abnormal structure, such as duplex-grain structure, and the Sn segregation were not observed in observing the micro structure using an optical microscope and investigating the Sn segregation by a line analysis using an EPMA. Therefore, it is understood that a smooth tube having the same quality as with an extruded material, can be produced by the casting and rolling process. An inner grooved tube having the same structure and the mechanical properties with an extruded material, can also be produced by applying the processes in Example 3 to a rolled bare tube produced using the casing and rolling process.

A copper alloy tube according to the present invention is excellent in its breaking pressure, therefore, it can be used for a heat transfer tube (smooth tube and inner grooved tube) for a heat exchanger using a refrigerant, such as carbon dioxide and fluorocarbon, and for a refrigerant pipe connecting an evaporator and a condenser of the heat exchanger, and for pipes installed therein. Moreover, the copper alloy tube according to the present invention can be used for a heat transfer tube, a water pipe, a kerosene pipe, a heat pipe, a four way valve, and a control copper tube, because the alloy tube is excellent in the breaking pressure after being subjected to brazing heating.

It should be understood by those skilled in the art that various modifications, combinations, subcombinations, and alterations may occur depending on design requirements and other factors insofar as they are within the scope of the appended claims or the equivalents thereof.

What is claimed is:

1. A copper alloy tube for a heat exchanger, comprising:

Sn 0.1 to 2.0 mass %, P 0.005 to 0.1 mass %, S 0.005 mass % or less, O 0.005 mass % or less, and H 0.0002 mass % or less; and the remainder has a composition consisting essentially of Cu and unavoidable impurities, wherein the copper alloy tube has, as is annealed, the following characteristics:

a tensile strength in the longitudinal direction of the copper alloy tube is 250 $N/mm^2$ or more;

an average grain diameter is 30 μm or less when measured in the direction perpendicular to the thickness direction of the tube, in the cross section perpendicular to the tube axis; and $\sigma T/\sigma L>0.93$, where $\sigma L$ is the tensile strength in the longitudinal direction of the copper alloy tube and $\sigma T$ is the tensile strength in the circumferential direction of the same copper alloy tube.

2. The copper alloy tube for a heat exchanger according to claim 1, wherein the tube further comprises Zn 0.01 to 1.0 mass %.

3. The copper alloy tube for a heat exchanger according to claim 1, wherein the tube further comprises a total amount of 0.005 to 0.07 mass % of Fe, Ni, Mn, Mg, Cr, Ti, and Ag.

4. The copper alloy tube for a heat exchanger according to claim 1, wherein the tube has, as is subjected to drawing processing, the following characteristics:

the tensile strength in the longitudinal direction of the copper alloy tube is 280 $N/mm^2$ or more; and an average grain diameter is 30 μm or less when measured in the direction perpendicular to the thickness direction of the tube, in the cross section perpendicular to the tube axis.

5. The copper alloy tube for a heat exchanger according to claim 1, wherein the copper alloy tube for a heat exchanger has, as is heated at 800° C. for 15 seconds, an average grain diameter of 100 μm or less when measured in the direction perpendicular to the thickness direction of the tube in the cross section perpendicular to the tube axis.

6. The copper alloy tube for a heat exchanger according to claim 1, wherein the copper alloy tube is an inner grooved tube.

7. The copper alloy tube for a heat exchanger according to claim 1, wherein $\sigma T/\sigma L>0.95$.

8. The copper alloy tube for a heat exchanger according to claim 1, wherein the S content is 0.003 mass % or less.

9. The copper alloy tube for a heat exchanger according to claim 1, wherein the S content is 0.0015 mass % or less.

10. The copper alloy tube for a heat exchanger according to claim 1, wherein the H content is 0.0001 mass % or less.

11. The copper alloy tube for a heat exchanger according to claim 1, wherein the average grain diameter is 20 μm or less when measured in the direction perpendicular to the thickness direction of the tube, in the cross section perpendicular to the tube axis.

12. The copper alloy tube for a heat exchanger according to claim 1, wherein the average grain diameter is 15 μm or less when measured in the direction perpendicular to the thickness direction of the tube, in the cross section perpendicular to the tube axis.

13. The copper alloy tube for a heat exchanger according to claim 3, wherein the tube further comprises a total amount of 0.005 to 0.05 mass % of Fe, Ni, Mn, Mg, Cr, Ti, and Ag.

14. The copper alloy tube for a heat exchanger according to claim 3, wherein the tube further comprises a total amount of 0.005 to 0.03 mass % of Fe, Ni, Mn, Mg, Cr, Ti, and Ag.

15. An copper alloy tube for a heat exchanger, comprising:

Sn 0.1 to 2.0 mass %, P 0.005 to 0.1 mass %, S 0.005 mass % or less, O 0.005 mass % or less, and H 0.0002 mass % or less; and the remainder has a composition consisting essentially of Cu and unavoidable impurities, wherein the copper alloy tube has, as annealed, the following characteristics:

a tensile strength in the longitudinal direction of the copper alloy tube is 250 $N/mm^2$ or more;

an average grain diameter is 30 μm or less when measured in the direction perpendicular to the thickness direction of the tube, in the cross section perpendicular to the tube axis; and $\sigma T/\sigma L\geq 0.95$, where $\sigma L$ is the tensile strength in the longitudinal direction of the copper alloy tube and $\sigma T$ is the tensile strength in the circumferential direction of the same copper alloy tube.

16. The copper alloy tube for a heat exchanger according to claim 15, wherein the tube further comprises Zn 0.01 to 1.0 mass %.

17. The copper alloy tube for a heat exchanger according to claim 15, wherein the tube further comprises a total amount of 0.005 to 0.07 mass % of Fe, Ni, Mn, Mg, Cr, Ti, and Ag.

18. The copper alloy tube for a heat exchanger according to claim 15, wherein the tube has, as is subjected to drawing processing, the following characteristics:

the tensile strength in the longitudinal direction of the copper alloy tube is 280 $N/mm^2$ or more; and an average grain diameter is 30 μm or less when measured in the direction perpendicular to the thickness direction of the tube, in the cross section perpendicular to the tube axis.

19. The copper alloy tube for a heat exchanger according to claim 15, wherein the copper alloy tube for a heat exchanger has, as is heated at 800° C. for 15 seconds, an average grain diameter of 100 μm or less when measured in the direction perpendicular to the thickness direction of the tube in the cross section perpendicular to the tube axis.

20. The copper alloy tube for a heat exchanger according to claim 15, wherein the copper alloy tube is an inner grooved tube.

* * * * *